US009685171B1

(12) United States Patent
Yang

(10) Patent No.: US 9,685,171 B1
(45) Date of Patent: Jun. 20, 2017

(54) MULTIPLE-STAGE ADAPTIVE FILTERING OF AUDIO SIGNALS

(71) Applicant: Amazon Technologies, Inc., Seattle, WA (US)

(72) Inventor: Jun Yang, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 70 days.

(21) Appl. No.: 13/682,362

(22) Filed: Nov. 20, 2012

(51) Int. Cl.
*G10L 21/0208* (2013.01)
*G10L 21/02* (2013.01)
*G10L 21/0216* (2013.01)

(52) U.S. Cl.
CPC *G10L 21/0205* (2013.01); *G10L 2021/02165* (2013.01)

(58) Field of Classification Search
CPC ..... G10L 2021/02165; G10L 21/0208
USPC ..... 704/224–226
See application file for complete search history.

(56) References Cited

U.S. PATENT DOCUMENTS 7,418,392 B1 8/2008 Mozer et al.
7,720,683 B1 5/2010 Vermeulen et al.
7,774,204 B2 8/2010 Mozer et al.
2004/0193411 A1* 9/2004 Hui ..... G10L 15/20 704/233
2005/0060142 A1* 3/2005 Visser et al. ..... 704/201
2008/0019537 A1* 1/2008 Nongpiur et al. ..... 381/71.7
2010/0217587 A1* 8/2010 Sato ..... G10L 21/0208 704/226
2010/0246851 A1* 9/2010 Buck ..... G10L 21/0208 381/94.1
2011/0130176 A1* 6/2011 Magrath ..... G10K 11/178 455/570
2011/0232989 A1* 9/2011 Lee ..... G01S 3/8034 181/125
2012/0123771 A1* 5/2012 Chen et al. ..... 704/226
2012/0189147 A1* 7/2012 Terada et al. ..... 381/313
2012/0223885 A1 9/2012 Perez
2012/0230511 A1* 9/2012 Burnett ..... 381/92
2012/0310637 A1* 12/2012 Vitte ..... G10L 21/0208 704/226

(Continued)

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

*Primary Examiner* — Douglas Godbold
(74) *Attorney, Agent, or Firm* — Lee & Hayes, PLLC

(57) ABSTRACT

The systems, devices, and processes described herein may include a first microphone that detects a target voice of a user within an environment and a second microphone that detects other noise within the environment. A target voice estimate and/or a noise estimate may be generated based at least in part on one or more adaptive filters. Based at least in part on the voice estimate and/or the noise estimate, an enhanced target voice and an enhanced interference, respectively, may be determined. One or more words that correspond to the target voice may be determined based at least in part on the enhanced target voice and/or the enhanced interference. In some instances, the one or more words may be determined by suppressing or canceling the detected noise.

20 Claims, 7 Drawing Sheets

(56) References Cited

U.S. PATENT DOCUMENTS

| | | | | |
|---|---|---|---|---|
| 2013/0034243 | A1* | 2/2013 | Yermeche et al. | 381/94.1 |
| 2013/0054233 | A1* | 2/2013 | Unno et al. | 704/226 |
| 2013/0066626 | A1* | 3/2013 | Liao | 704/211 |
| 2013/0156208 | A1* | 6/2013 | Banba | G10L 21/0208 381/60 |
| 2013/0158989 | A1* | 6/2013 | Song et al. | 704/226 |

* cited by examiner

MULTIPLE-STAGE ADAPTIVE FILTERING OF AUDIO SIGNALS

BACKGROUND

Homes are becoming more wired and connected with the proliferation of computing devices such as desktops, tablets, entertainment systems, and portable communication devices. As computing devices evolve, many different ways have been introduced to allow users to interact with these devices, such as through mechanical means (e.g., keyboards, mice, etc.), touch screens, motion, and gesture. Another way to interact with computing devices is through speech.

When interacting with a device through speech, a device may perform automatic speech recognition (ASR) on audio signals generated from sound captured within an environment for the purpose of identifying voice commands within the signals. However, the presence of audio in addition to a user's voice command (e.g., background noise, etc.) may make difficult the task of performing ASR on the audio signals.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
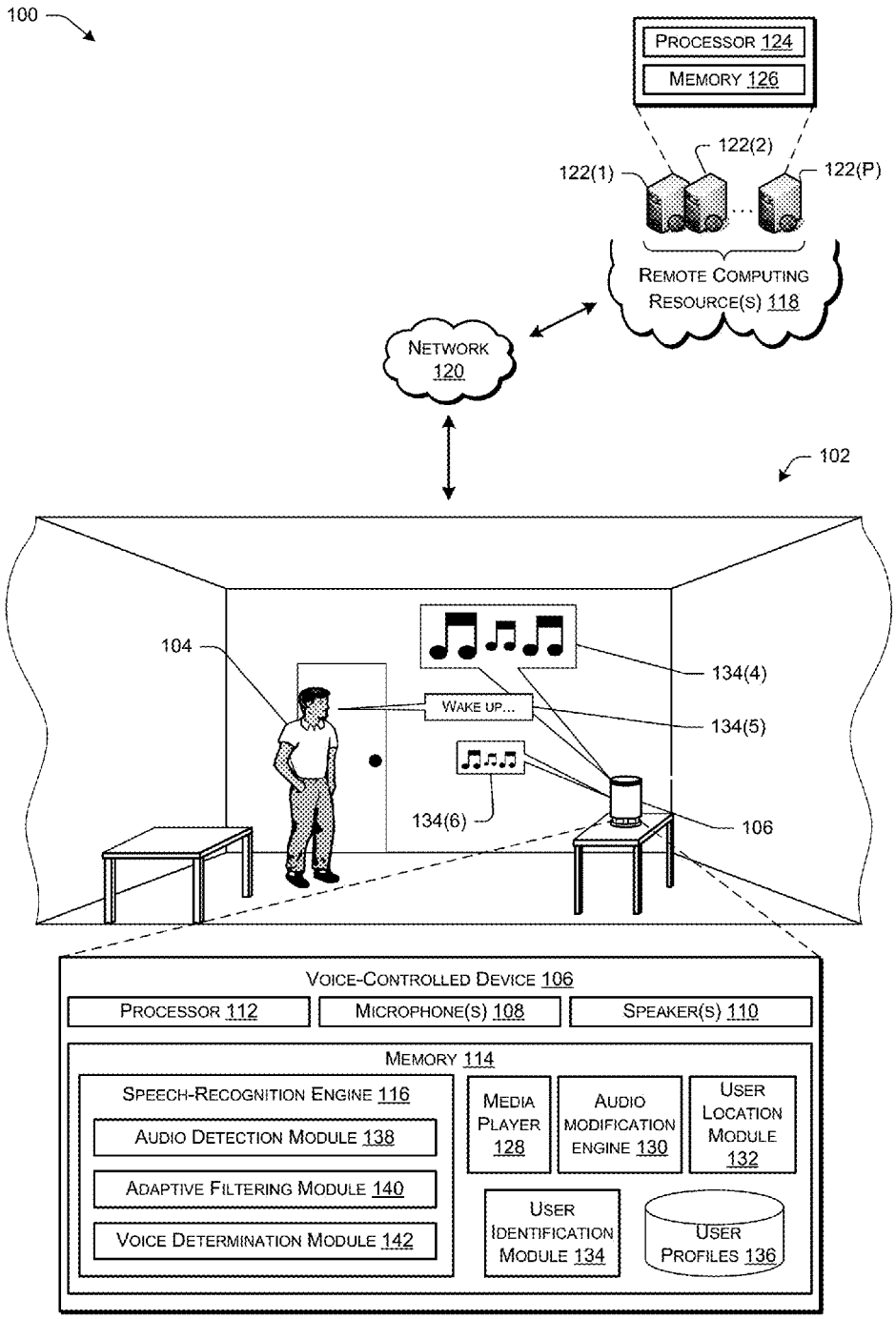
FIG. 1 shows an illustrative voice interaction computing architecture that may be set in a home environment. The architecture includes a voice-controlled device physically situated in the environment, along with one or more users who may wish to provide a command to the device. In response to detecting a particular voice or predefined word within the environment, the device may enhance the voice and reduce other noise within the environment in order to increase the accuracy of automatic speech recognition (ASR) performed by the device.

This disclosure describes, in part, systems and processes for utilizing multiple microphones to enable more accurate automatic speech recognition (ASR) by a voice-controlled device. More particularly, the systems and processes described herein may utilize adaptive directionality, such as by implementing one or more adaptive filters, to enhance a detected voice or sound within an environment. In addition, the systems and processes described herein may utilize adaptive directionality to reduce other noise within the environment in order to enhance the detected voice or sound.

Various speech or voice detection techniques may be utilized by devices within an environment to detect, process, and determine one or more words uttered by a user. Beamforming or spatial filtering may be used in the context of sensor array signal processing in order to perform signal enhancement, interference suppression, and direction of arrival (DOA) estimation. In particular, spatial filtering may be useful within an environment since the signals of interest (e.g., a voice) and interference (e.g., background noise) may be spatially separated. Since adaptive directionality may allow a device to be able to track time-varying and/or moving noise sources, devices utilizing adaptive directionality may be desirable with respect to detecting and recognizing user commands within the environment. For instance, oftentimes a device is situated within an environment that has various types of audio signals that the device would like to detect and enhance (e.g., user commands) and audio signals that the device would like to ignore or suppress (e.g., ambient noise, other voices, etc.). Since a user is likely to speak on an ongoing basis and possibly move within the environment, adaptive directionality may allow the device to better identify words or phrases uttered by a user.

For a device having multiple (e.g., two) microphones that are configured to detect a target voice (e.g., from a user) and noise (e.g., ambient or background noise), adaptive functionality may be achieved by altering the delay of the system, which may correspond to the transmission delay of the detected noise between a first microphone and a second microphone. However, it may be difficult to effectively estimate the amount of delay of the noise when the noise and the target voice are both present. Provided that the amount of delay is determined, it also may be difficult to implement this delay in real-time. Moreover, existing techniques that have previously been used to achieve adaptive directionality cannot be implemented in low power devices due to the limit of hardware size, the number of microphones present, the distance between the microphones, lack of computational speed, mismatch of microphones, lack of a power supply, etc.

Accordingly, the systems and processes described herein relate to a more practical and effective adaptive directionality system for a device having multiple (e.g., two) microphones, where the two microphones may be either omnimicrophones or directional microphones. Moreover, these systems and processes described herein may be applied when the microphones are in an endfire orientation or when the microphones are in a broadside orientation. In the endfire configuration, the sound of interest (e.g., the target voice) may correspond to an axis that represents a line connecting the two microphones. On the other hand, in the broadside configuration, the sound of interest may be on a line transverse to this axis.

Provided that the device has two microphones, one of the microphones may be referred to as a primary (or main) microphone that is configured to detect the target voice, while the other microphone may be referred to as a reference microphone that is configured to detect other noise. In various embodiments, the primary microphone and the reference microphone may be defined in a way such that the primary microphone has a larger input signal-to-noise ratio (SNR) or a larger sensitivity than the reference microphone.

In other embodiments, in the endfire configuration, the primary microphone may be positioned closer to the target user's mouth (thus having a higher input SNR) and may also have a larger sensitivity (if any) than the reference microphone. For the broadside configuration, the primary microphone may also have a larger sensitivity (if any) than the reference microphone.

In some embodiments, the primary microphone of the device may detect a target voice from a user within an environment and the reference microphone of the device may detect other noise within the environment. An adaptive filter associated with the device may then interpret or process the detected target voice and noise. However, in response to the primary microphone detecting the target voice, the adaptive filter may be frozen until the reference microphone detects any other noise within the environment. An amount of delay that corresponds to a particular length of the adaptive filter may be applied to the desired signal (e.g., the delay may be applied to the channel corresponding to the first microphone). In some embodiments, the amount of delay may correspond to approximately half of the length of the adaptive filter.

In response to the target voice and the noise being detected, the adaptive filter may adapt (e.g., enhance) the target voice based at least in part on the detected ambient noise. More particularly, the adaptive filter may determine an estimate of the target voice and/or an estimate of the ambient noise. Then, the adaptive filter may enhance the detected voice while suppressing the ambient noise, which may allow the device to identify terms or commands uttered by the target user, and then perform any corresponding actions based on those terms or commands.

The devices and techniques described above and below may be implemented in a variety of different architectures and contexts. One non-limiting and illustrative implementation is described below.

FIG. 1 shows an illustrative voice interaction computing architecture 100 set in an environment 102, such as a home environment 102, that includes a user 104. The architecture 100 also includes an electronic voice-controlled device 106 (interchangeably referred to as "device 106") with which the user 104 may interact. In the illustrated implementation, the voice-controlled device 106 is positioned on a table within a room of the environment 102. In other implementations, it may be placed in any number of locations (e.g., ceiling, wall, in a lamp, beneath a table, under a chair, etc.). Further, more than one device 106 may be positioned in a single room, or one device 106 may be used to accommodate user interactions from more than one room.

Generally, the voice-controlled device 106 may have a microphone unit that includes at least one microphone 108 (and potentially multiple microphones 108) and a speaker unit that includes at least one speaker 110 to facilitate audio interactions with the user 104 and/or other users 104. In some instances, the voice-controlled device 106 is implemented without a haptic input component (e.g., keyboard, keypad, touch screen, joystick, control buttons, etc.) or a display. In certain implementations, a limited set of one or more haptic input components may be employed (e.g., a dedicated button to initiate a configuration, power on/off, etc.). Nonetheless, the primary and potentially only mode of user interaction with the electronic device 106 may be through voice input and audible output. One example implementation of the voice-controlled device 106 is provided below in more detail with reference to FIG. 2.

The microphone(s) 108 of the voice-controlled device 106 may detect audio (e.g. audio signals) from the environment 102, such as sounds uttered from the user 104 and/or other noise within the environment 102. As illustrated, the voice-controlled device 106 may include a processor 112 and memory 114, which stores or otherwise has access to a speech-recognition engine 116. As used herein, the processor 112 may include multiple processors 112 and/or a processor 112 having multiple cores. The speech-recognition engine 116 may perform speech recognition on audio captured by the microphone(s) 108, such as utterances spoken by the user 104. The voice-controlled device 106 may perform certain actions in response to recognizing different speech from the user 104. The user 104 may speak predefined commands (e.g., "Awake", "Sleep", etc.), or may use a more casual conversation style when interacting with the device 106 (e.g., "I'd like to go to a movie. Please tell me what's playing at the local cinema.").

In some instances, the voice-controlled device 106 may operate in conjunction with or may otherwise utilize computing resources 118 that are remote from the environment 102. For instance, the voice-controlled device 106 may couple to the remote computing resources 118 over a network 120. As illustrated, the remote computing resources 118 may be implemented as one or more servers 122(1), 122(2), . . . , 122(P) and may, in some instances, form a portion of a network-accessible computing platform implemented as a computing infrastructure of processors 112, storage, software, data access, and so forth that is maintained and accessible via a network 120 such as the Internet. The remote computing resources 118 may not require end-user knowledge of the physical location and configuration of the system that delivers the services. Common expressions associated for these remote computing resources 118 may include "on-demand computing", "software as a service (SaaS)", "platform computing", "network-accessible platform", "cloud services", "data centers", and so forth.

The servers 122(1)-(P) may include a processor 124 and memory 126, which may store or otherwise have access to some or all of the components described with reference to the memory 114 of the voice-controlled device 106. For instance, the memory 126 may have access to and utilize the speech-recognition engine 116 for receiving audio signals from the device 106, recognizing, and differentiating between, speech and other noise and, potentially, causing an action to be performed in response. In some examples, the voice-controlled device 106 may upload audio data to the remote computing resources 118 for processing, given that the remote computing resources 118 may have a computational capacity that exceeds the computational capacity of the voice-controlled device 106. Therefore, the voice-controlled device 106 may utilize the speech-recognition engine 116 at the remote computing resources 118 for performing relatively complex analysis on audio captured from the environment 102.

Regardless of whether the speech recognition occurs locally or remotely from the environment 102, the voice-controlled device 106 may receive vocal input from the user 104 and the device 106 and/or the resources 118 may perform speech recognition to interpret a user's 104 operational request or command. The requests may be for essentially type of operation, such as authentication, database inquires, requesting and consuming entertainment (e.g., gaming, finding and playing music, movies or other content, etc.), personal management (e.g., calendaring, note taking, etc.), online shopping, financial transactions, and so forth. The speech recognition engine 116 may also interpret noise detected by the microphone(s) 108 and determine that the noise is not from the target source (e.g., the user 104). To interpret the user's 104 speech, an adaptive filter associated with the speech recognition engine 116 may make a distinction between the target voice (of the user 104) and other noise within the environment 102 (e.g., other voices, audio from a television, background sounds from a kitchen, etc.). As a result, the adaptive filter may be configured to enhance the target voice while suppressing ambient noise that is detected within the environment 102.

The voice-controlled device 106 may communicatively couple to the network 120 via wired technologies (e.g., wires, USB, fiber optic cable, etc.), wireless technologies (e.g., RF, cellular, satellite, Bluetooth, etc.), or other connection technologies. The network 120 is representative of any type of communication network, including data and/or voice network, and may be implemented using wired infrastructure (e.g., cable, CATS, fiber optic cable, etc.), a wireless infrastructure (e.g., RF, cellular, microwave, satellite, Bluetooth, etc.), and/or other connection technologies.

As illustrated, the memory 114 of the voice-controlled device 106 may also store or otherwise has access to the speech recognition engine 116, a media player 128, an audio modification engine 130, a user location module 132, a user identification module 134, and one or more user profiles 136. Although not shown, in other embodiments, the speech recognition engine 116, the media player 128, the audio modification engine 130, the user location module 132, the user identification module 134, and the one or more user profiles 136 may be maintained by, or associated with, one of the remote computing resources 118. The media player 128 may function to output any type of content on any type of output component of the device 106. For instance, the media player 128 may output audio of a video or standalone audio via the speaker 110. For instance, the user 104 may interact (e.g., audibly) with the device 106 to instruct the media player 128 to cause output of a certain song or other audio file.

The audio modification engine 130, meanwhile, functions to modify the output of audio being output by the speaker 110 or a speaker of another device for the purpose of increasing efficacy of the speech recognition engine 116. For instance, in response to receiving an indication that the user 104 is going to provide a voice command to the device 106, the audio modification engine 130 may somehow modify the output of the audio to increase the accuracy of speech recognition performed on an audio signal generated from sound captured by the microphone 108. The engine 130 may modify output of the audio being output by the device 106, or audio being output by another device that the device 106 is able to interact with (e.g., wirelessly, via a wired connection, etc.).

As described above, the audio modification engine 130 may attenuate the audio, pause the audio, switch output of the audio from stereo to mono, attenuate a particular frequency range of the audio, turn off one or more speakers 110 outputting the audio or may alter the output of the audio in any other way. Furthermore, the audio modification engine 130 may determine how or how much to alter the output the audio based on one or more of an array of characteristics, such as a distance between the user 104 and the device 106, a direction of the user 104 relative to the device 106 (e.g., which way the user 104 is facing relative to the device 106), the type or class of audio being output, the identity of the user 104 himself, a volume of the user's 104 speech indicating that he is going to provide a subsequent voice command to the device 106, or the like.

The user location module 132 may function to identify a location of the user 104 within the environment 102, which may include the actual location of the user 104 in a two-dimensional (2D) or a three-dimensional (3D) space, a distance between the user 104 and the device 106, a direction of the user 104 relative to the device 106, or the like. The user location module 132 may determine this location information in any suitable manner. In some examples, the device 106 includes multiple microphones 108 that each generates an audio signal based on sound that includes speech of the user 104 (e.g., the user 104 stating "wake up" to capture the device's 106 attention). In these instances, the user location module 132 may utilize time-difference-of-arrival (TDOA) techniques to determine a distance of the user 104 from the device 106. That is, the user location module 132 may cross-correlate the times at which the different microphones 108 received the audio to determine a location of the user 104 relative to the device 106 and, hence, a distance between the user 104 and the device 106.

In another example, the device 106 may include a camera that captures images of the environment 102. The user location module 132 may then analyze these images to identify a location of the user 104 and, potentially, a distance of the user 104 to the device 106 or a direction of the user 104 relative to the device 106. Based on this location information, the audio modification engine 130 may determine how to modify output of the audio (e.g., whether to turn off a speaker 110, whether to instruct the media player 128 to attenuate the audio, etc.).

Next, the user identification module 134 may utilize one or more techniques to identify the user 104, which may be used by the audio modification module 130 to determine how to alter the output of the audio. In some instances, the user identification module 134 may work with the speech recognition engine 116 to determine a voice print of the user 104 and, thereafter, may identify the user 104 based on the voice print. In examples where the device 106 includes a camera, the user identification module 134 may utilize facial recognition techniques on images captured by the camera to identify the user 104. In still other examples, the device 106 may engage in a back-and-forth dialogue to identify and authenticate the user 104. Of course, while a few examples have been listed, the user identification module 134 may identify the user 104 in any other suitable manner.

After identifying the user 104, the device 106 (e.g., the audio modification engine 130 or the user identification module 134) may reference a corresponding user profile 136 of the identified user 104 to determine how to alter the output of the audio. For instance, one user 104 may have configured the device 106 to pause the audio, while another user 104 may have configured the device 106 to attenuate the audio. In other instances, the device 106 may itself determine how best to alter the audio based on one or more characteristics associated with the user 104 (e.g., a general volume level or frequency of the user's 104 speech, etc.). In one example, the device 106 may identify a particular frequency range associated with the identified user 104 and may attenuate that frequency range in the audio being output.

In various embodiments, the speech-recognition module 116 may include, or be associated with, an audio detection module 138, an adaptive filtering module 140, and a voice determination module 142. The audio detection module 138 may detect various audio signals within the environment 102, where the audio signals may correspond to voices of users 104 or other ambient noise (e.g., a television, a radio, footsteps, etc.) within the environment 102. For instance, the audio detection module 138 may detect a voice of a target user 104 (e.g., a target voice) and other noise (e.g., voices of other users 104). The target voice may be a voice of a user 104 that the voice-controlled device 106 is attempting to detect and the target voice may correspond to one or more words that are directed to the voice-controlled device 106.

In response to detecting the audio signals (e.g., the detected target voice and the noise), the adaptive filtering module 140 may utilize one or more adaptive filters in order to enhance the target voice and to suppress the other noise. Then, the voice determination module 142 may determine the one or more words that correspond to the target voice, which may represent a command uttered by the user 104. That is, in response to the target voice being enhanced and the ambient noise being reduced or minimized, the voice determination module 142 may identify the words spoken by the target user 104. Based at least in part on the identified words, a corresponding action or operation may be performed by the voice-controlled device 106.

Figure 2:
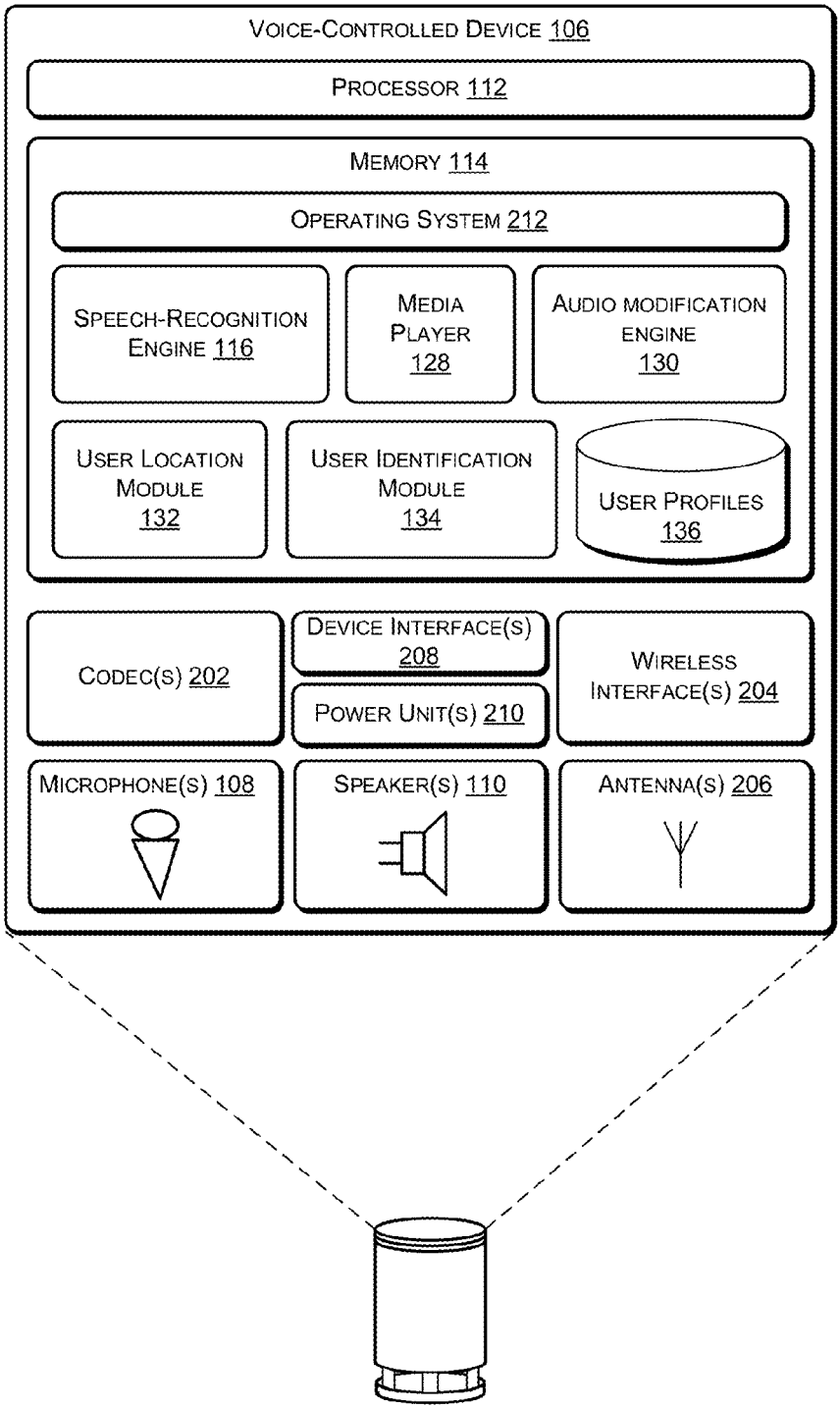
FIG. 2 shows a block diagram of selected functional components implemented in the voice-controlled device of FIG. 1.

FIG. 2 shows selected functional components of one implementation of the voice-controlled device 106 in more detail. Generally, the voice-controlled device 106 may be implemented as a standalone device 106 that is relatively simple in terms of functional capabilities with limited input/output components, memory 114 and processing capabilities. For instance, the voice-controlled device 106 may not have a keyboard, keypad, or other form of mechanical input in some implementations, nor does it have a display or touch screen to facilitate visual presentation and user touch input. Instead, the device 106 may be implemented with the ability to receive and output audio, a network interface (wireless or wire-based), power, and limited processing/memory capabilities.

In the illustrated implementation, the voice-controlled device 106 may include the processor 112 and memory 114. The memory 114 may include computer-readable storage media ("CRSM"), which may be any available physical media accessible by the processor 112 to execute instructions stored on the memory 114. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other medium which can be used to store the desired information and which can be accessed by the processor 112.

The voice-controlled device 106 may include a microphone unit that comprises one or more microphones 108 to receive audio input, such as user voice input and/or other noise. The device 106 also includes a speaker unit that includes one or more speakers 110 to output audio sounds. One or more codecs 202 are coupled to the microphone 108 and the speaker 110 to encode and/or decode the audio signals. The codec 202 may convert audio data between analog and digital formats. A user 104 may interact with the device 106 by speaking to it, and the microphone 108 may capture sound and generate an audio signal that includes the user speech. The codec 202 may encode the user speech and transfer that audio data to other components. The device 106 can communicate back to the user 104 by emitting audible statements through the speaker 110. In this manner, the user 104 interacts with the voice-controlled device 106 simply through speech, without use of a keyboard or display common to other types of devices.

In the illustrated example, the voice-controlled device 106 may include one or more wireless interfaces 204 coupled to one or more antennas 206 to facilitate a wireless connection to a network. The wireless interface 204 may implement one or more of various wireless technologies, such as Wi-Fi, Bluetooth, radio frequency (RF), and so on.

One or more device interfaces 208 (e.g., USB, broadband connection, etc.) may further be provided as part of the device 106 to facilitate a wired connection to a network, or a plug-in network device that communicates with other wireless networks. One or more power units 210 may further be provided to distribute power to the various components of the device 106.

The voice-controlled device 106 may be designed to support audio interactions with the user 104, in the form of receiving voice commands (e.g., words, phrase, sentences, etc.) from the user 104 and outputting audible feedback to the user 104. Accordingly, in the illustrated implementation, there are no or few haptic input devices, such as navigation buttons, keypads, joysticks, keyboards, touch screens, and the like. Further there is no display for text or graphical output. In one implementation, the voice-controlled device 106 may include non-input control mechanisms, such as basic volume control button(s) for increasing/decreasing volume, as well as power and reset buttons. There may also be one or more simple light elements (e.g., LEDs around perimeter of a top portion of the device 106) to indicate a state such as, for example, when power is on or to indicate when a command is received. But, otherwise, the device 106 may not use or need to use any input devices or displays in some instances.

Several modules such as instructions, datastores, and so forth may be stored within the memory 114 and configured to execute on the processor 112. An operating system 212 may be configured to manage hardware and services (e.g., wireless unit, Codec, etc.) within, and coupled to, the device 106 for the benefit of other modules.

In addition, the memory 114 may include the speech-recognition engine 116, the media player 128, the audio modification engine 130, the user location module 132, the user identification module 134 and the user profiles 136. Although not shown in FIG. 2, the speech-recognition engine 116 may include the audio detection module 138, the adaptive filtering module 140, and the voice determination module 142. Also as discussed above, some or all of these engines, data stores, and components may reside additionally or alternatively at the remote computing resources 118.

Figure 3:
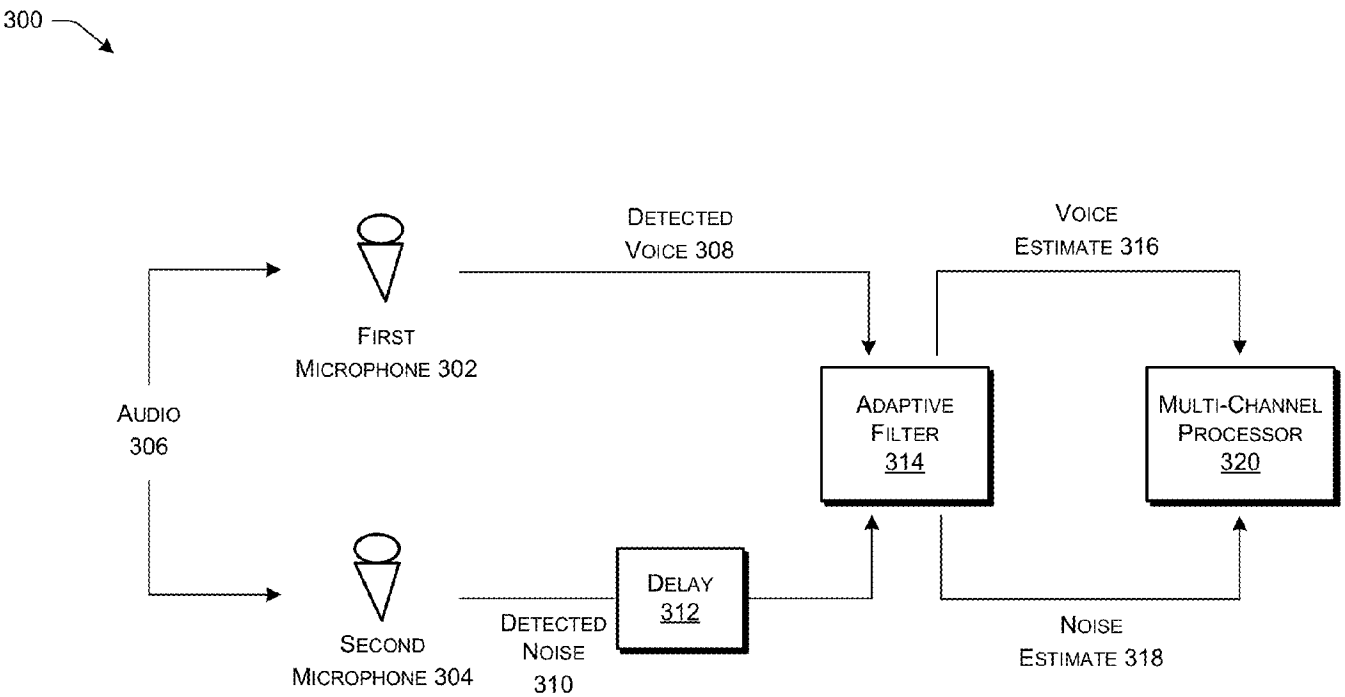
FIG. 3 shows an illustrative one-stage adaptive filtering system for estimating a target voice and noise within an environment.

FIG. 3 shows an illustrative system 300 for estimating a target voice and/or other noise within an environment. In various embodiments, the system 300 may correspond to a one-stage adaptive beamforming process, which may be performed by, or associated with, the voice-controlled device 106 or one or more of the remote computing resources 118. In some embodiments, the system 300 may include multiple microphones, including a first microphone 302 and a second microphone 304. The first microphone 302 may be referred to as a main or a primary microphone, whereas the second microphone 304 may be referred to as a reference or secondary microphone.

The first microphone 302 and the second microphone 304 may detect audio 306 (e.g., audio signals) from within an environment. The audio 306 may correspond to a voice from one or more users 104 and other noise within the environment. More particularly, the first microphone 302 may be configured to detect a specific voice uttered by a particular user 104 (e.g., detected voice 308). That is, the system 300 may attempt to detect words or phrases (e.g., commands) that are associated with a target user 104. In addition, the second microphone 304 may be configured to detect noise within the environment (e.g., detected noise 310). The detected noise 310 may correspond to voices from users 104 other than the target user 104 and/or other ambient noise or interference within the environment (e.g., audio from devices, footsteps, etc.). As a result, the first microphone 302 and the second microphone 304 may detect a target voice from a specific user 104 (e.g., detected voice 308) and other noise within the environment (e.g., detected noise 310). Due to the amount of detected noise 310, it may be difficult for the system 300 to identify the specific words, phrases, or commands that correspond to the detected voice 308.

In certain embodiments, in response to the first microphone 302 detecting the detected (e.g., target) voice 308 and/or the second microphone 304 detecting the detected noise 310, adaptation with respect to the system 300 may be frozen when the interference is detected. More particularly, in response to the first microphone 302 detecting the target voice and/or the second microphone 304 detecting the ambient noise, an adaptive filter 314 may be frozen until the target voice is detected. The amount of the delay 312 may correspond to a particular length of the adaptive filter 314 that may be applied to the desired signal (e.g., the delay may be applied to the channel corresponding to the first microphone 302).

Following the delay 312, the adaptive filter 314 may determine a voice estimate 316 and a noise estimate 318. The voice estimate 316 may correspond to an estimate of the detected voice 308 that is associated with the target user 104. Moreover, the noise estimate 318 may represent an accurate estimate of the amount of noise within the environment. As a result, the output of the adaptive filter 314 may correspond to an estimate of the target voice of the user 104 and/or an estimate of the total amount of noise within the environment. In some embodiments, the voice estimate 316 and the noise estimate 318 may be utilized to determine the words, phrases, sentences, etc., that are uttered by the user 104 and detected by the system 300. More particular, this may be performed by a multi-channel processor 320 that enhances the detected voice 308 by suppressing or reducing the other noise detected within the environment. In other embodiments, the multi-channel processor 320 may be a two-channel time frequency domain post-processor, or the multi-channel processor 320 may instead have a single channel.

Figure 4:
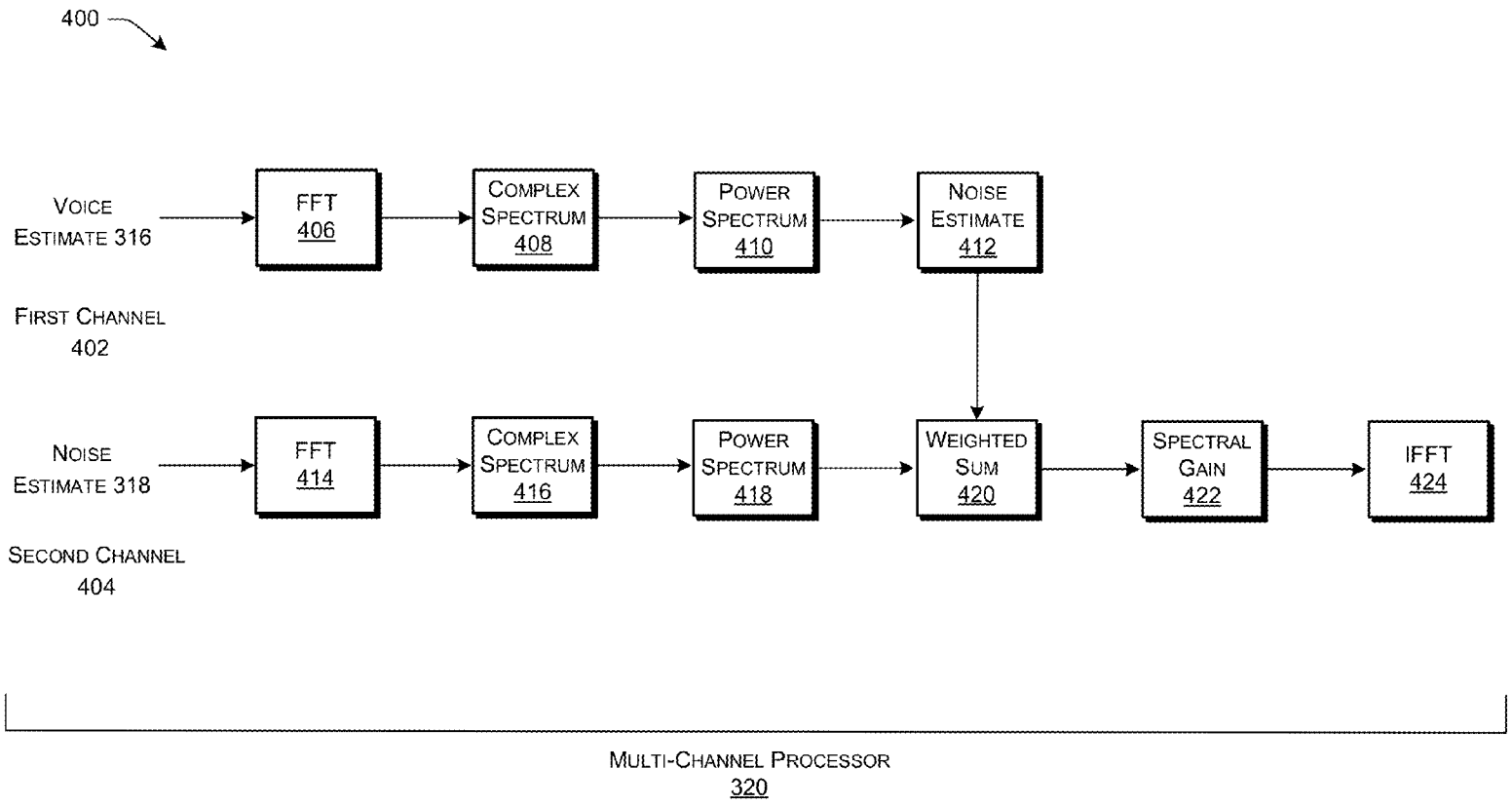
FIG. 4 shows an illustrative two-channel processing system for determining a target voice based at least in part on suppressing noise within an environment.

FIG. 4 shows an illustrative system 400 for performing two-channel time frequency domain processing with respect to a target voice and noise detected within an environment. In some embodiments, the processes set forth herein with respect to FIG. 4 may be performed by the multi-channel processor 320, as shown in FIG. 3. In some embodiments, the system 400 may include multiple channels, such as a first channel 402 and a second channel 404, to process the audio signals (e.g., the target voice, noise, etc.) detected within the environment. More particularly, the first channel 402 and the second channel 404 may process the voice estimate 316 associated with the ambient stationary noise and the noise estimate 318 that is associated with (and may be primarily associated with) the ambient non-stationary noise, respectively. Use of the multiple channels may reduce the amount of noise detected by the microphones of the voice-controlled device 106, which may therefore enhance the detected target voice.

In some embodiments, one or more algorithms, such as a fast Fourier transform (FFT 406), may be utilized to process the voice estimate 316. For the purposes of this discussion, the FFT 406 may correspond to an algorithm that may compute a discrete Fourier transform (DFT), and its corresponding inverse. It is contemplated that various different FFTs 406 may be utilized with respect to the voice estimate 316. Moreover, the DFT may decompose a sequence of values associated with the voice estimate 316 into components having different frequencies.

In response to application of the one or more algorithms (e.g., the FFT 406), the system 400 may generate a complex spectrum 408 of the voice estimate 316. The complex spectrum 408 (or frequency spectrum) of a time-domain audio signal (e.g., the voice estimate 316) may be a representation of that signal in the frequency domain. For the purposes of this discussion, the frequency domain may correspond to the analysis of mathematical functions or signals with respect to frequency, as opposed to time (e.g., time domain). In these embodiments, the complex spectrum 408 may be generated via the FFT 406 of the voice estimate 316, and the resulting values may be presented as amplitude and phase, which may both be plotted with respect to frequency. The complex spectrum 408 may also show harmonics, which are visible as distinct spikes or lines, that may provide information regarding the mechanisms that generate the entire audio signal of the voice estimate 316.

Moreover, a power spectrum 410 (e.g., spectral density, power spectral density (PSD), energy spectral density (ESD), etc.) may be generated based at least in part on the complex spectrum 408. In various embodiments, the power spectrum 410 may be associated with the voice estimate 316 and may correspond to a positive real function of a frequency variable associated with a stationary stochastic process, or a deterministic function of time. That is, the power spectrum 410 may measure the frequency content of the stochastic process and may help identify any periodicities. From the power spectrum 410, a noise estimate 412 associated with the voice estimate 316 may be determined.

As with the voice estimate 316 associated with the first channel 402, the noise estimate 318, as determined in FIG. 3, may be processed with respect to the second channel 404, which may be separate from the first channel 402. In various embodiments, an FFT 414 of the noise estimate 318 may be utilized to generate a complex spectrum 416. Furthermore, a power spectrum 418 with respect to the noise estimate 318 may be generated based at least in part on the complex spectrum 416. As a result, a noise estimate 412 associated with the ambient stationary noise and a noise estimate associated with the ambient non-stationary noise of the environment may be summed to generate a weighted sum 420 or weighted value. The weighted sum 420 may represent a total amount of noise detected within the environment, which may include ambient stationary noise and other non-stationary audio detected within the environment. Therefore, a summation of the noise from both the first channel 402 and the second channel 404 may be determined and used to reduce the amount of ambient noise that is detected within the environment.

The weighted sum 420 may be utilized to generate a spectral gain 422 associated with the target voice and the detected noise. In some embodiments, the spectral gain 422 may be representative of an extent to which the target voice and/or the ambient noise is detected within the environment, and the spectral gain 422 may have an inverse relationship (e.g., inversely proportional) with respect to the power spectrum 410 and/or 418. In various embodiments, the spectral gain 422 may correspond to the ratio of the spread (or radio frequency (RF)) bandwidth to the unspread (or baseband) bandwidth, and may be expressed in decibels (dBs). Furthermore, if the amount of noise within the environment is relatively high, it may be desirable to reduce the noise in order to enhance the detected target voice.

Based at least in part on the determined spectral gain 422, an inverse fast Fourier transform (IFFT 424) may be utilized. In particular, multiplying the original complex spectrum (e.g., the output of the FFT 406) with the spectral gain 422 may result in the complex spectrum (e.g., complex spectrum 408 and/or 416) of the cleaned target voice (e.g., the target voice without the noise). The IFFT 424 may be utilized to convert the obtained complex spectrum of the cleaned target voice, which may be determined with respect to the frequency domain, to the time domain and to, therefore, enhance the target voice. Accordingly, the multi-channel processor may use two different channels (e.g., the first channel 402 and the second channel 404), which are associated with the first microphone 302 and the second microphone 304, to enhance the detected voice 308 associated with the target user 104. Moreover, the target voice may be enhanced by suppressing, canceling, or minimizing other noise within the environment (e.g., ambient noise, other voices, interference, etc.), which may allow the system 400 to identify the words, phrases, sentences, etc. uttered by the target user 104.

Figure 5:
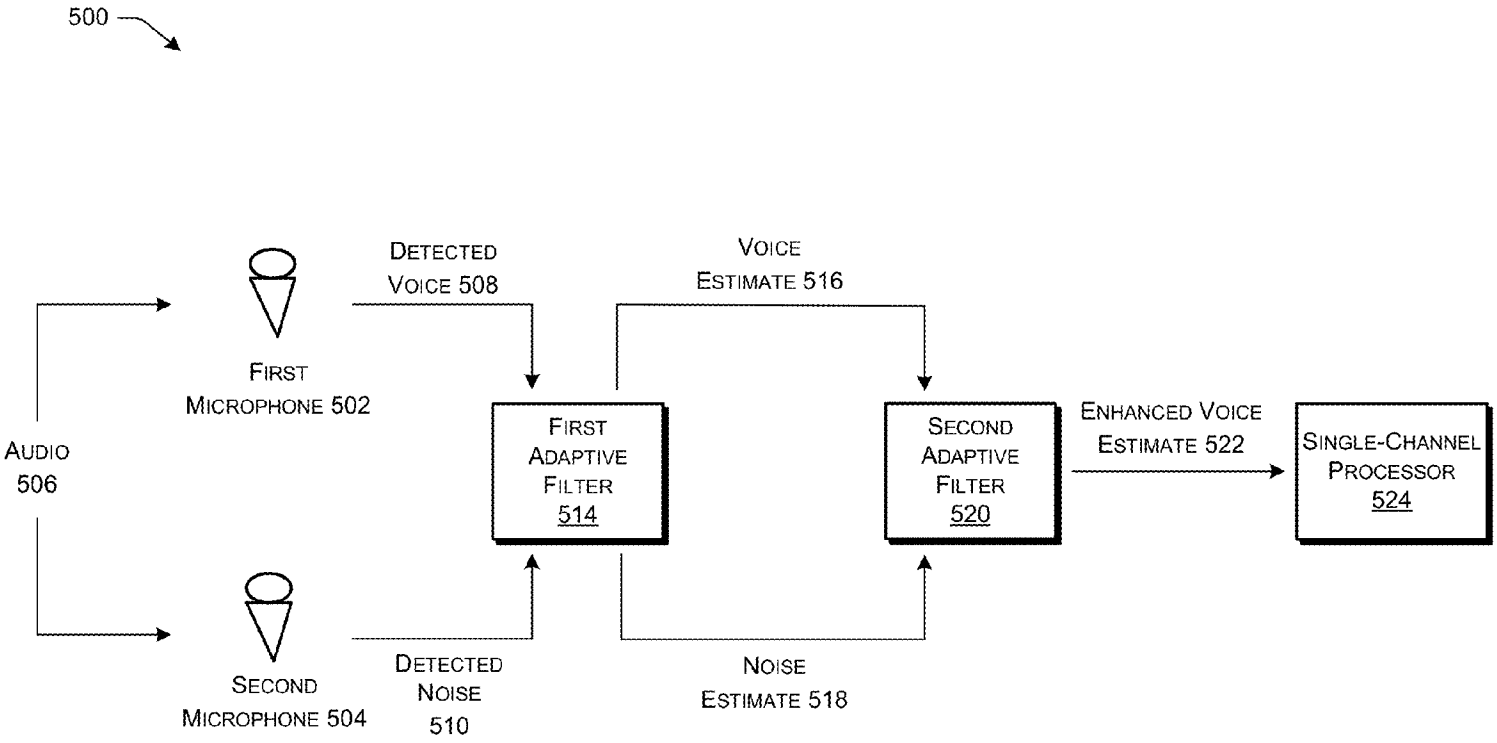
FIG. 5 shows an illustrative two-stage adaptive filtering system for enhancing a target voice within an environment based at least in part on a single-channel process.

FIG. 5 shows an illustrative system 500 for detecting and determining a target voice within an environment. More particularly, the system 500 may represent a two-stage process for detecting, processing, and determining an utterance from a target user 104 by suppressing or canceling other noise that is detected within the environment. Alternatively, or in addition to the one-stage system as shown in FIG. 3, in the two-stage system 500 as illustrated in FIG. 5, the adaptation of the first stage may be frozen when the interference (e.g., other noise) is detected, and is updated when target voice is detected (e.g., target voice 508). Therefore, the output of the adaptive filtering being performed by the first adaptive filter 514 may be the noise estimation 518. Moreover, the adaptation of the second stage may be frozen when the target voice is detected. Accordingly, the output of the adaptive filtering being performed by the second adaptive filter 520 may be the enhanced voice estimate 522. In various embodiments, the subsequent detection of target voice may be more accurate than the initial detection due to the separation between the target voice and the interference performed during the first stage.

As shown in FIG. 5, a first microphone 502 and a second microphone 504, which each may be associated with the voice-controlled device 106 or one of the remote computing resources 118, may detect audio 506 (e.g., audio signals) within an environment. The first microphone 502 may detect a detected voice 508, which may represent one or more words uttered by a target user 104. The second microphone 504 may detect detected noise 510, which may correspond to other noise within the environment. In some embodiments, a first adaptive filter 514 may process the detected voice 508 and the detected noise 510 in order to generate a noise estimate 518, where the voice estimate 516 may be based on the detected voice 508. Moreover, a second adaptive filter 520 may output an enhanced voice estimate 522 based at least in part on the voice estimate 516 and the noise estimate 518. The enhanced voice estimate 522 may then be passed on to a single-channel processor 524 (e.g., the first channel 402, as shown in FIG. 4) that may be utilized to enhance and determine one or more words uttered by the target user 104 by suppressing or canceling other noise within the environment.

In certain embodiments, in response to the first microphone 502 detecting the detected voice 508 (e.g., via voice activity detection (VAD)), adaptation being performed by the first adaptive filter 514 may be frozen or updated. Following the first adaptive filter 514 being frozen or updated, the first adaptive filter 514 may utilize one or more algorithms to adapt the detected voice 508. As a result, the output of the first adaptive filter 514 may represent an estimate of the voice of the target user 104 (e.g., the voice estimate 516).

Moreover, VAD may be utilized to detect miscellaneous noise (e.g., detected noise 510) within the environment, where the noise may then be adapted by the second adaptive filter 520. As a result, the output of the second adaptive filter 520 may correspond to an estimate of the interference noise (e.g., the noise estimate 518), which may be utilized to determine the enhanced voice estimate 522. In various embodiments, in response to detecting the noise/interference within the environment, adaptation of the second adaptive filter 520 may also be frozen or updated. Moreover, after the second adaptive filter 520 generates the enhanced voice estimate 522, the enhanced voice estimate 522 may be utilized by the single-channel processor 524 to remove or cancel miscellaneous noise that is detected within the environment, which may result in the target voice being accurately interpreted and identified.

Figure 6:
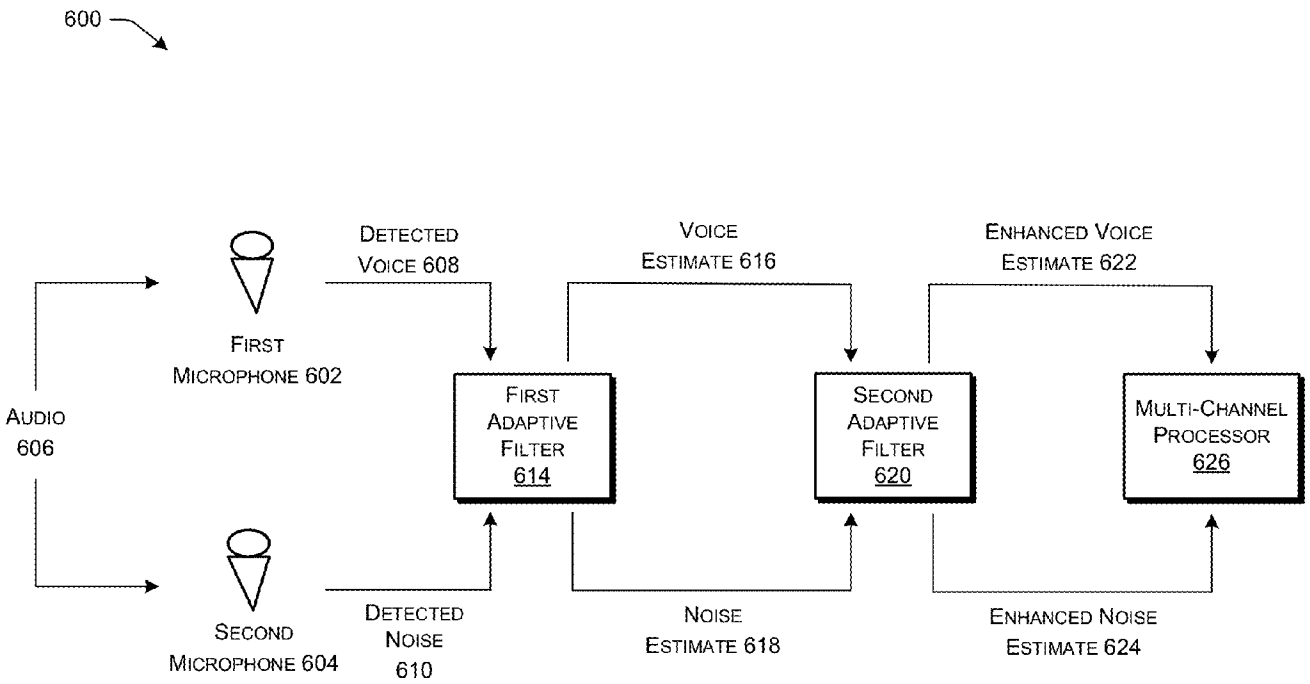
FIG. 6 shows an illustrative two-stage adaptive filtering system for enhancing a target voice within an environment based at least in part on a two-channel process.

FIG. 6 shows an illustrative system 600 for detecting and determining a target voice within an environment. More particularly, the system 600 may represent a two-stage process for detecting, processing, and determining an utterance from a target user 104 by suppressing or canceling other noise that is detected within the environment. In some embodiments, the systems and processes described herein with respect to FIG. 6 may be performed by the voice-controlled device 106 and/or one of the remote computing resources 118. Alternatively, or in addition to the one-stage system as shown in FIG. 3, in the two-stage system 600 as illustrated in FIG. 6, the adaptation of the first stage may be updated when a target voice is detected. Moreover, the adaptation of the second stage may be updated when interference (e.g., other noise) is detected. In various embodiments, the subsequent detection of noise may be more accurate than the initial detection due to the separation between the target voice and the interference performed during the first stage.

As shown in FIG. 6, a first microphone 602 and a second microphone 604, which each may be associated with the voice-controlled device 106 and/or one of the remote computing resources 118, may detect audio 606 (e.g., audio signals) within an environment. The first microphone 602 may detect a detected voice 608, which may represent one or more words uttered by a target user 104. The second microphone 604 may detect detected noise 610, which may correspond to other noise within the environment. In some embodiments, a first adaptive filter 614 may process the detected voice 608 and the detected noise 610 in order to generate a noise estimate 618. In other embodiments, a voice estimate 616 may be determined from the detected voice 608. Moreover, a second adaptive filter 620 may output an enhanced voice estimate 622 and an enhanced noise estimate 624 based at least in part on the voice estimate 616 and/or the noise estimate 618. The enhanced voice estimate 622 and the enhanced noise estimate 624 may then be passed on to a multi-channel processor 626 (discussed with respect to FIG. 4) that may be utilized to enhance and determine one or more words uttered by the target user 104 by suppressing or canceling other noise within the environment.

In certain embodiments, in response to the first microphone 602 detecting the detected voice 608 (e.g., via voice activity detection (VAD)), adaptation being performed by the first adaptive filter 614 may be frozen or updated. Afterwards, the first adaptive filter 614 may utilize one or more algorithms to adapt the detected voice 608. As a result, the output of the first adaptive filter 614 may represent the noise estimate 618 and an estimate of the voice of the target user 104 (e.g., the voice estimate 616).

Moreover, VAD may be utilized to detect miscellaneous noise (e.g., detected noise 610) within the environment, where the noise may then be adapted by the second adaptive filter 620. As a result, the output of the second adaptive filter 620 may correspond to an estimate of the interference noise, which may be utilized to determine the enhanced voice estimate 622 and the enhanced noise estimate 624. In various embodiments, in response to detecting the noise/interference within the environment, adaptation of the second adaptive filter 620 may also be frozen or updated. Moreover, after the second adaptive filter 620 generates the enhanced voice estimate 622 and the enhanced noise estimate 624, the enhanced voice estimate 622 and the enhanced noise estimate 624 may be utilized by the multi-channel processor 626 to remove or cancel miscellaneous noise that is detected within the environment, which may result in the target voice being accurately interpreted and identified.

Figure 7:
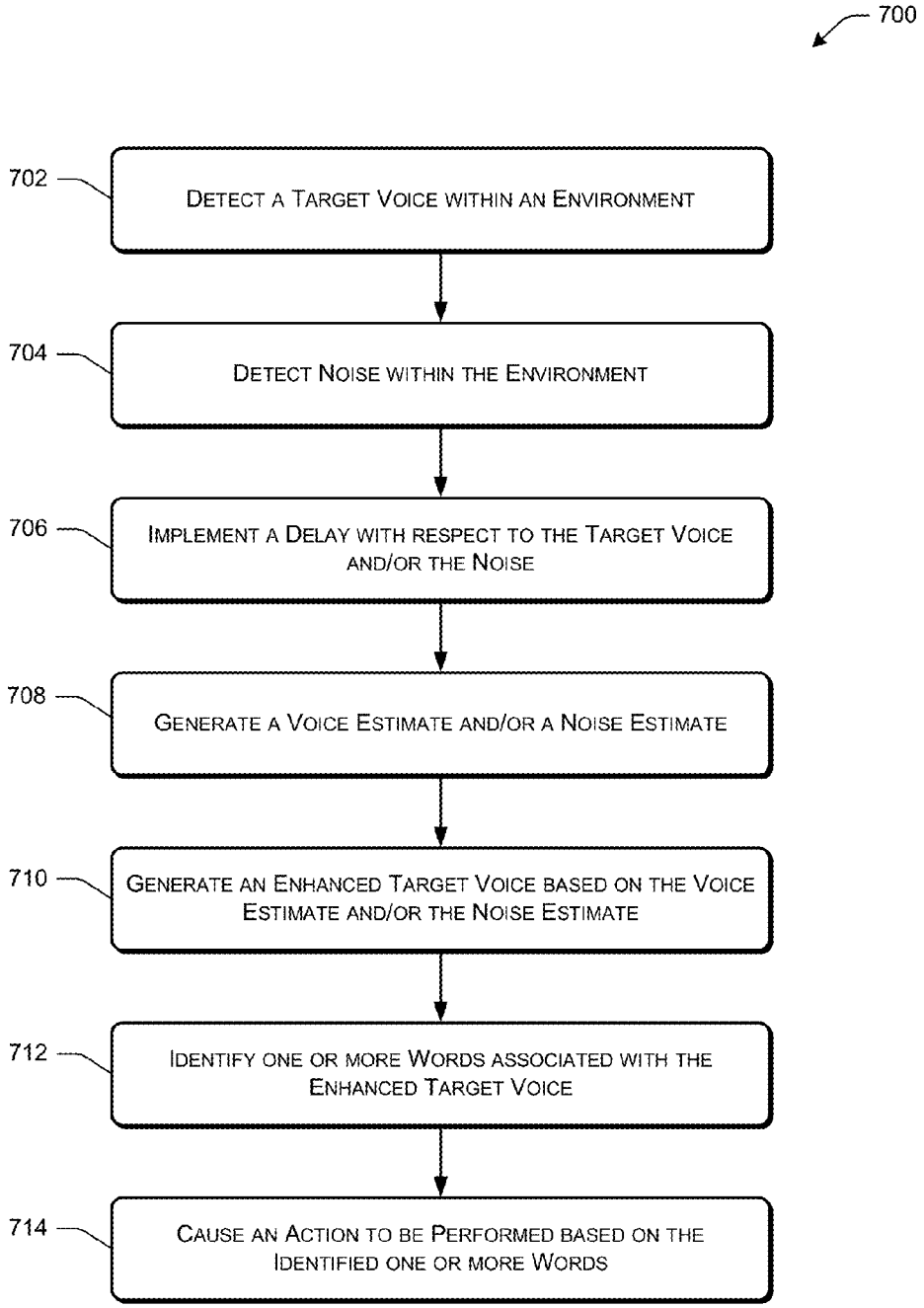
FIG. 7 depicts a flow diagram of an example process for enhancing a particular voice within an environment and reducing other noise, which may be performed by the voice-controlled device of FIG. 1, to increase the efficacy of ASR by the device.

FIG. 7 depicts a flow diagram of an example process 700 for detecting and identifying a target voice within an environment. The voice-controlled device 106, the remote computing resources 118, other computing devices or a combination thereof may perform some or all of the operations described below.

The process 700 is illustrated as a logical flow graph, each operation of which represents a sequence of operations that can be implemented in hardware, software, or a combination thereof. In the context of software, the operations represent computer-executable instructions stored on one or more computer-readable media that, when executed by one or more processors, perform the recited operations. Generally, computer-executable instructions include routines, programs, objects, components, data structures, and the like that perform particular functions or implement particular abstract data types.

The computer-readable media may include non-transitory computer-readable storage media, which may include hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of storage media suitable for storing electronic instructions. In addition, in some embodiments the computer-readable media may include a transitory computer-readable signal (in compressed or uncompressed form). Examples of computer-readable signals, whether modulated using a carrier or not, include, but are not limited to, signals that a computer system hosting or running a computer program can be configured to access, including signals downloaded through the Internet or other networks. Finally, the order in which the operations are described is not intended to be construed as a limitation, and any number of the described operations can be combined in any order and/or in parallel to implement the process.

Block 702 illustrates detecting a target voice within an environment. In some embodiments, a first microphone may detect a voice (e.g., a target voice) from a specific user (e.g., a target user) within the environment, where the user may be uttering one or more commands directed at the voice-controlled device. As a result, the voice-controlled device may continuously attempt to detect that user's voice.

Block 704 illustrates detecting noise within the environment. More particularly, a second microphone may detect noise within the environment other than the detected target voice. Such noise may include ambient noise, voices of other users, and/or any other interference within the environment.

Block 706 illustrates implementing a delay with respect to the target voice and/or the noise. In various embodiments, an adaptive filter that may process the detected target voice and/or the detected noise may be frozen or updated. In order to synchronize the main channel and reference channel associated with the adaptive filtering of the target voice and/or the noise, the delay may correspond to a particular length of the adaptive filter (e.g., approximately half of the length of the adaptive filter).

Block 708 illustrates generating a voice estimate and/or a noise estimate. More particularly, the adaptive filter may process the detected target voice and the detected noise in order to generate estimates with respect to the detected target voice and the detected noise within the environment.

Block 710 illustrates generating en enhanced target voice based on the voice estimate and/or the noise estimate. In particular, the detected target voice may be enhanced based at least in part by suppressing, canceling, or minimizing any of the noise or interference detected by either of the microphones, which may cause the detected target voice to be emphasized Block 712 illustrates identifying one or more words associated with the enhanced target voice. In some embodiments, in response to suppressing any noise or interference that is detected, the system 700 may identify one or more words that were actually uttered by the target user. The one or more words may be identified based at least in part on various VAD and/or ASR techniques.

Block 714 illustrates causing an action to be performed based on the identified one or more words. That is, in response to determining the words uttered by the user, a corresponding action may be performed. For instance, if it is determined that the target user requested that the lights be turned on, the system 700 may cause the lights to be turned on. As a result, the system 700 may identify commands issued by a particular user and perform corresponding actions in response.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A system comprising:

memory;

one or more processors; and one or more computer-executable instructions stored in the memory and executable by the one or more processors to:

cause a first microphone to detect a target voice associated with a user within an environment and to cause a second microphone to detect noise within the environment;

implement a delay with respect to a first audio signal that represents the noise and refrain from delaying a second audio signal that represents the target voice;

terminate the delay based at least in part on detecting the noise;

process, by a first adaptive filter, the target voice to generate a target voice estimate, the target voice estimate representing a first estimate of the target voice of the user;

process, by the first adaptive filter, the noise to generate a noise estimate, the noise estimate representing a second estimate of the noise within the environment; and generate, by a second adaptive filter different from the first adaptive filter, an enhanced target voice based at least in part on the target voice estimate and the noise estimate, and based at least in part on a suppression of the noise.

2. The system as recited in claim 1, wherein the delay starts at a first time at which the first microphone detects the noise and ends at a second time at which the second microphone detects the noise, the delay being implemented with respect to a synchronization between the first microphone and the second microphone.

3. The system as recited in claim 1, wherein the one or more computer-executable instructions are further executable by the one or more processors to:

determine one or more words that correspond to the target voice based at least in part on the enhanced target voice and the suppression of the noise; and cause an operation to be performed within the environment based at least in part on the one or more words.

4. The system as recited in claim 1, wherein the first adaptive filter implements the delay utilizing one or more algorithms.

5. A system comprising:

a first microphone to detect a first sound;

a second microphone to detect a second sound;

memory;

one or more processors; and one or more computer-executable instructions stored in the memory and executable by the one or more processors to perform operations comprising:

determining that the first sound is representative of at least a portion of a target voice;

determining that the second sound is representative of at least a portion of noise;

implementing a delay with respect to a first audio signal that represents the noise and refraining from delaying a second audio signal that represents the target voice;

terminating the delay based at least in part on detecting the noise;

processing, by a first adaptive filter, the target voice to generate a target voice estimate, the target voice estimate representing a first estimate of the target voice of a user associated with the first sound;

processing, by the first adaptive filter, the noise to generate a noise estimate, the noise estimate representing a second estimate of the noise within an environment associated with the user; and generating, by a second adaptive filter different from the first adaptive filter, an enhanced target voice based at least in part on the target voice estimate and the noise estimate.

6. The system as recited in claim 5, wherein the operations further comprise determining one or more words that correspond to the target voice based at least in part on the enhanced target voice.

7. The system as recited in claim 6, wherein the operations further comprise causing an operation to be performed within an environment based at least in part on the one or more words.

8. The system as recited in claim 5, wherein the operations further comprise:

determining that the target voice is associated with the user within the environment; and determining that the noise is different from the target voice.

9. The system as recited in claim 5, wherein the delay is associated with a first time at which the first microphone detects the second sound and a second time at which the second microphone detects the second sound, and wherein the operations further comprise:

implementing the delay with respect to a synchronization between the first microphone and the second microphone.

10. The system as recited in claim 9, wherein an amount of the delay is based on a length of the first adaptive filter, and wherein the operations further comprise adjusting the amount of the delay based at least in part on at least one of the target voice estimate or the noise estimate.

11. The system as recited in claim 5, wherein the operations further comprise determining the enhanced target voice based at least in part on a suppression of the noise.

12. A method comprising:

determining that a first sound captured by a first microphone is representative of at least a portion of a target voice;

determining that a second sound captured by a second microphone is representative of at least a portion of noise;

implementing a delay with respect to a first audio signal that represents the noise and refraining from delaying a second audio signal that represents the target voice;

terminating the delay based at least in part on detecting the noise;

processing, by a first adaptive filter, the target voice to generate a target voice estimate, the target voice estimate representing a first estimate of the target voice of a user associated with the first sound;

processing, by the first adaptive filter, the noise to generate a noise estimate, the noise estimate representing a second estimate of the noise within an environment associated with the user; and generating, by a second adaptive filter different from the first adaptive filter, an enhanced target voice based at least in part on at least one of the target voice estimate or the noise estimate.

13. The method as recited in claim 12, wherein the delay is associated with a first time at which the first microphone captured the second sound and a second time at which the second microphone captured the second sound, the delay corresponding to a synchronization between the first microphone and the second microphone, and further comprising:

determining an amount of the delay based at least partly on a length of the first adaptive filter.

14. The method as recited in claim 13, further comprising adjusting the amount of the delay based at least in part on at least one of the target voice estimate or the noise estimate.

15. The method as recited in claim 12, further comprising:

suppressing at least a portion of the noise; and determining the enhanced target voice based at least in part on the suppressing of the at least the portion of the noise.

16. A method comprising:

detecting a first sound representative of a target voice and a second sound representative of noise, the first sound being captured by a first microphone and the second sound being captured by a second microphone;

implementing a delay with respect to a first audio signal that represents the noise and refraining from delaying a second audio signal that represents the target voice;

terminating the delay based at least in part on detecting the noise;

processing, by a first adaptive filter, the target voice to generate a target voice estimate, the target voice estimate representing a first estimate of the target voice of a user associated with the first sound;

processing, by the first adaptive filter, the noise to generate a noise estimate, the noise estimate representing a second estimate of the noise within an environment associated with the user; and generating, by a second adaptive filter different from the first adaptive filter, an enhanced target voice based at least in part on at least one of the target voice estimate or the noise estimate.

17. The method as recited in claim 16, wherein the delay being is with a first time at which the first microphone detects the second sound and a second time at which the second microphone detects the second sound, and further comprising:

determining the delay based at least in part on a synchronization between the first microphone and the second microphone.

18. The method as recited in claim 17, further comprising adjusting the amount of the delay based at least in part on at least one of the target voice estimate or the noise estimate.

19. The method as recited in claim 16, further comprising determining the enhanced target voice based at least in part on a suppression of the noise.

20. The method as recited in claim 16, further comprising:

determining one or more words that correspond to the target voice based at least in part on the enhanced target voice; and causing an operation to be performed within an environment based at least in part on the one or more words.

* * * * *